US009726379B2

(12) United States Patent
Wiseman et al.

(10) Patent No.: US 9,726,379 B2
(45) Date of Patent: Aug. 8, 2017

(54) MEASUREMENT DEVICE FOR DETERMINING OVEN HEATING PARAMETERS

(71) Applicant: General Electric Company, Schenectady, NY (US)

(72) Inventors: Joshua Stephen Wiseman, Elizabethtown, KY (US); James Lee Armstrong, Louisville, KY (US); Stephen Bernard Froelicher, Shepherdsville, KY (US)

(73) Assignee: HAIER US APPLIANCE SOLUTIONS, INC., Wilmington, DE (US)

( * ) Notice: Subject to any disclaimer, the term of this patent is extended or adjusted under 35 U.S.C. 154(b) by 232 days.

(21) Appl. No.: 14/709,590

(22) Filed: May 12, 2015

(65) Prior Publication Data

US 2016/0334112 A1 Nov. 17, 2016

(51) Int. Cl.
*H05B 3/68* (2006.01)
*F24C 7/08* (2006.01)

(52) U.S. Cl.
CPC ..... *F24C 7/085* (2013.01)

(58) Field of Classification Search
CPC . F24C 7/085; A21B 1/245; A21B 1/24; A21B 1/26; A21B 1/33; A21B 1/36; A21B 1/40; G01N 25/4813; G01N 25/482; G01N 25/4833; B01F 15/00396; B01F 15/00155; B01F 15/00175
See application file for complete search history.

(56) References Cited

U.S. PATENT DOCUMENTS 4,716,819 A * 1/1988 Beltz ..... A21B 5/00 99/419
5,161,889 A 11/1992 Smith et al.
2015/0117136 A1* 4/2015 Eble ..... B01F 15/0035 366/142

* cited by examiner

*Primary Examiner* — Shawntina Fuqua
(74) *Attorney, Agent, or Firm* — Dority & Manning, P.A.

(57) ABSTRACT

A measurement device for determining heating parameters of an oven may generally include a support plate and at least one sensor cup coupled to the support plate. The sensor cup may define a liquid well for receiving a volume of liquid and may include a bottom wall defining a floor of the liquid well. In addition, the measurement device may include a temperature sensor positioned adjacent to the floor of the liquid well such that the temperature sensor is configured to be in fluid contact with at least a portion of the volume of the liquid received within the liquid well. The temperature sensor may be configured to monitor a temperature of the liquid as the liquid is heated and evaporates from the sensor cup.

20 Claims, 6 Drawing Sheets

MEASUREMENT DEVICE FOR DETERMINING OVEN HEATING PARAMETERS

FIELD OF THE INVENTION

The present subject matter relates generally to ovens and, more particularly, to a measurement device for determining oven heating parameters.

BACKGROUND OF THE INVENTION

Restaurants often have very expensive, specialized appliances for cooking certain types of foods. For example, many restaurants have custom-made, wood-fired brick ovens that are used for cooking pizza, bread and other food items that are desired to be cooked at high temperatures. These ovens typically include a hearth and a dome made from refractory materials and a cooking deck covered by the dome. Food to be cooked is typically placed directly onto the cooking deck and is heated via three different types of heat transfer. Specifically, due to the dome, the oven has a natural airflow therethrough that provides for convective heating. In addition, the dome's surface reflects heat downward towards the cooking deck to provide radiative heating onto the food placed on the deck while heat is transferred directly to the food from the cooking deck via conduction.

Given the differing types of heat transfer occurring within a brick oven, it is often difficult to obtain an accurate measurement of the heating parameters of the oven. For example, existing temperature sensing devices are not equipped to accurately determine the heat energy transferred into food placed within a brick oven. Moreover, this issue is compounded by the fact that brick ovens are typically custom made such that each oven has unique heating conditions/parameters that impact that manner in which heat is transferred into the food being cooked.

Accordingly, an improved measurement device for accurately determining one or more heating parameters of a brick oven or any other suitable type of oven would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a system for determining oven heating parameters. The system may generally include an oven defining an oven floor and a measurement device configured to be positioned within the oven. The measurement device may generally include a support plate, wherein the support plate defines a lower surface facing the oven floor and an upper surface opposite the lower surface. The measurement device may also include an upper sensor cup and a lower sensor cup coupled to the support plate. The upper sensor cup may define an upper liquid well for receiving a first volume of liquid. The upper sensor cup may also include a bottom wall defining a floor of the upper liquid well, wherein the upper sensor cup is positioned relative to the support plate such that at least a portion of the bottom wall of the upper liquid well is positioned above the upper surface of the support plate. The lower sensor cup may define a lower liquid well for receiving a second volume of liquid. The lower sensor cup may also include a bottom wall defining a floor of the lower liquid well, wherein the lower sensor cup is positioned relative to the support plate such that at least a portion of the bottom wall of the lower sensor cup is positioned below the lower surface of the support plate. In addition, the measurement device may also include a first temperature sensor positioned adjacent to the floor of the upper liquid well such that the first temperature sensor is configured to be in fluid contact with at least a portion of the first volume of liquid received within the upper liquid well. The first temperature sensor may be configured to monitor a temperature of the liquid contained within the upper liquid well as the liquid is heated and evaporates from the upper sensor cup due to heat transferred from the oven. Moreover, the measurement device may also include a second temperature sensor positioned adjacent to the floor of the lower liquid well such that the second temperature sensor is configured to be in fluid contact with at least a portion of the second volume of liquid received within the lower liquid well. The second temperature sensor may be configured to monitor a temperature of the liquid contained within the lower liquid well as the liquid is heated and evaporates from the lower sensor cup due to heat transferred from the oven.

In another aspect, the present subject matter is directed to a measurement device for determining heating parameters of an oven. The measurement device may generally include a support plate and at least one sensor cup coupled to the support plate. The sensor cup may define a liquid well for receiving a volume of liquid and may include a bottom wall defining a floor of the liquid well. In addition, the measurement device may include a temperature sensor positioned adjacent to the floor of the liquid well such that the temperature sensor is configured to be in fluid contact with at least a portion of the volume of the liquid received within the liquid well. The temperature sensor may be configured to monitor a temperature of the liquid as the liquid is heated and evaporates from the sensor cup.

In a further aspect, the present subject matter is directed to a method for determining oven heating parameters. The method may generally include positioning a measurement device within an oven, wherein the measurement device includes a support plate and at least one sensor cup coupled to the support plate. The sensor cup may define a liquid well for receiving a volume of liquid and may include a bottom wall defining a floor of the liquid well. The measurement device may also include a temperature sensor positioned adjacent to the floor of the liquid well such that the temperature sensor is configured to be in fluid contact with at least a portion of the volume of the liquid contained within the liquid well. In addition, the method may include heating the volume of liquid contained within the liquid well via heat transferred from the oven, monitoring a temperature of the liquid contained within the liquid well over time using the temperature sensor as the liquid is heated and evaporates from the liquid well and determining at least one heating parameter of the oven based on the monitored temperatures.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
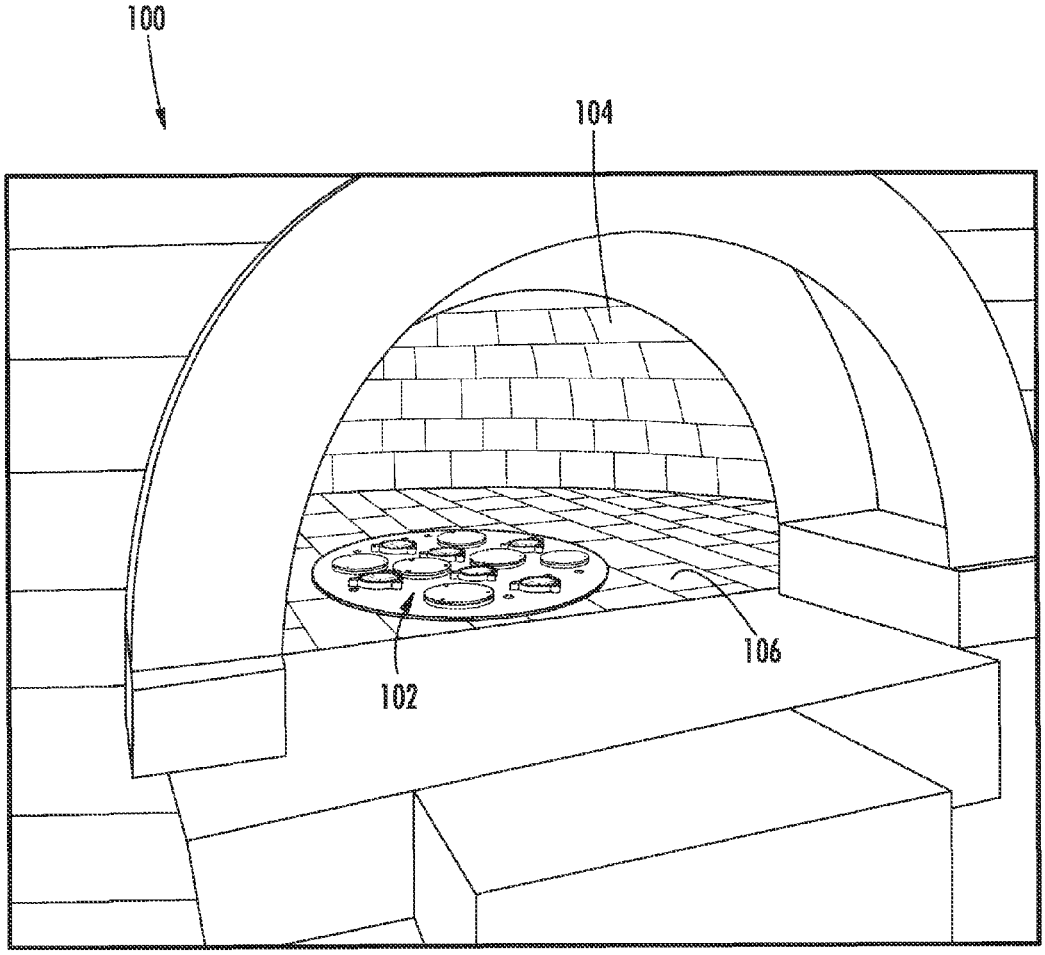
FIG. 1 illustrates a perspective view of one embodiment of an oven and a measurement device positioned within the oven for determining one or more heating parameters of the oven in accordance with aspects of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a measurement device for determining one or more heating parameters of an oven. In general, the measurement device may be configured to be placed within an operating oven in order to monitor its heating parameters, such as heat energy and power output parameters of the oven. In several embodiments, the measurement device may include a plurality of sensor cups configured to be coupled to and/or supported by a support plate. Each sensor cup may define a liquid well for receiving a liquid (e.g., water). In addition, the measurement device may include a temperature sensor associated with each sensor cup for measuring the temperature of the liquid contained within the liquid well as the liquid is heated and evaporates away from the sensor cup due to the heat transferred from the oven. The temperature measurements provided by the temperature sensor may then be analyzed to determine one or more heating parameters of the oven, such as by correlating the temperature measurements to corresponding heat and power outputs for raising the temperature of the liquid to its boiling point and/or corresponding heat and power outputs for fully boiling away the liquid from each sensor cup.

In several embodiments, the measurement device may include two different types of sensor cups for measuring the different types of heat transfer occurring within the oven. For example, as will be described below, the measurement device may include one or more lower sensor cups configured to be supported by the support plate such that the lower sensor cup(s) contacts the floor of the oven. As a result, the lower sensor cup(s) may be heated significantly via conduction of heat from the oven floor through the portion of the sensor cup(s) contacting the floor. In such an embodiment, the lower sensor cup(s) may be shielded from the air circulating within the oven (e.g., via a cover a plate) to ensure that the primary mode of heat transfer into the lower sensor cup(s) is conduction from the oven floor as opposed to convection and/or radiation from the oven. Similarly, the measurement device may also include one or more upper sensor cups configured to be supported by the support plate such that the upper sensor cup(s) are spaced apart from the oven floor. As a result, the upper sensor cup(s) may be heated significantly via radiation and convection from the oven. In such an embodiment, the upper sensor cup(s) may be shielded from the oven floor (e.g., via the support plate) to ensure that the primary mode of heat transfer into the upper sensor cup(s) is radiation and convection as opposed to conduction.

It should be appreciated that, in several embodiments, the measurement device will be described herein with reference to a brick oven, such as a wood-fired brick pizza oven utilized within a restaurant. By utilizing the disclosed measurement device to analyze and determine the heating parameters of a given restaurant pizza oven, a consumer oven appliance may be designed and/or controlled in a manner that allows the oven appliance to mimic the cooking conditions of the analyzed restaurant pizza oven. For example, consumers may have a favorite pizza restaurant that utilizes a specialized wood-burning brick oven to cook their pizzas. The disclosed measurement device would allow the heating parameters of the restaurant's specialized oven to be determined with a high degree of accuracy. The determined heating parameters may then be input into a consumer oven appliance to allow pizza to be cooked within the appliance using the same heating parameters, thereby providing a means for consumers to enjoy restaurant-quality pizza at home.

It should also be appreciated that, although the measurement device will generally be described herein with reference to its use within a brick oven, the measurement device may also be utilized within any other suitable type of oven or other heated environment in order to monitor and/or determine the heating parameters within such oven and/or other heated environment.

Referring now to FIG. 1, a front perspective view of an oven 100 having one embodiment of a measurement device 102 positioned therein for determining one or more heating parameters of the oven 100 is illustrated in accordance with aspects of the present subject matter. As shown, the oven 100 is configured as a restaurant-style, brick oven. As is generally understood, such ovens are typically formed from brick, stones or other similar materials, with the interior of the oven 100 being heated using wood, coal or gas. As indicated above, unlike many ovens, food is cooked within a brick oven using a combination of convection, radiation and conduction. For example, as shown in FIG. 1, the oven 100 may include a dome 104 surrounding a deck or oven floor 106 onto which food (e.g., pizza) is placed for cooking. As such, in addition to traditional convective heating, the bricks, stones or other suitable materials forming the dome 104 may be configured to reflect heat towards the oven floor 106, thereby providing radiative heating. Moreover, given the direct contact between the oven floor 106 and the food being cooked, heat may be transferred directly from the oven floor 106 to the food via conduction.

It should be appreciated that, in other embodiments, the oven 100 may correspond to any other suitable type of oven having any other suitable configuration. For example, the oven 100 may be configured as a deck oven having stone shelves or decks onto which food is directly placed for cooking. Alternatively, the oven 100 may have any other suitable oven configuration, such as by being configured as a convection oven or any other type of oven.

In several embodiments, a measurement device 102 may be positioned within the oven 100 in order to determine one or more heating parameters of the oven. For example, as shown in FIG. 1, the measurement device 102 may be placed within the oven 100 such that a least a portion of the device 102 contacts and/or is supported by the oven floor 106. As will be described below, the measurement device 102 may be configured to measure the different types of heat transfer occurring within the oven 100 (e.g., convection, radiation and conduction) by monitoring the temperature of liquid contained within individual sensor cups of the measurement device 102. The temperature measurements may then be analyzed to determine one or more heating parameters of the oven 100, such as by determining the energy and power outputs from the oven 100 as received by the measurement device 102. In this manner, the measurement device 102 may provide an accurate assessment of the amount and intensity of the heat transferred from the oven 100 into food placed therein.

Figure 2:
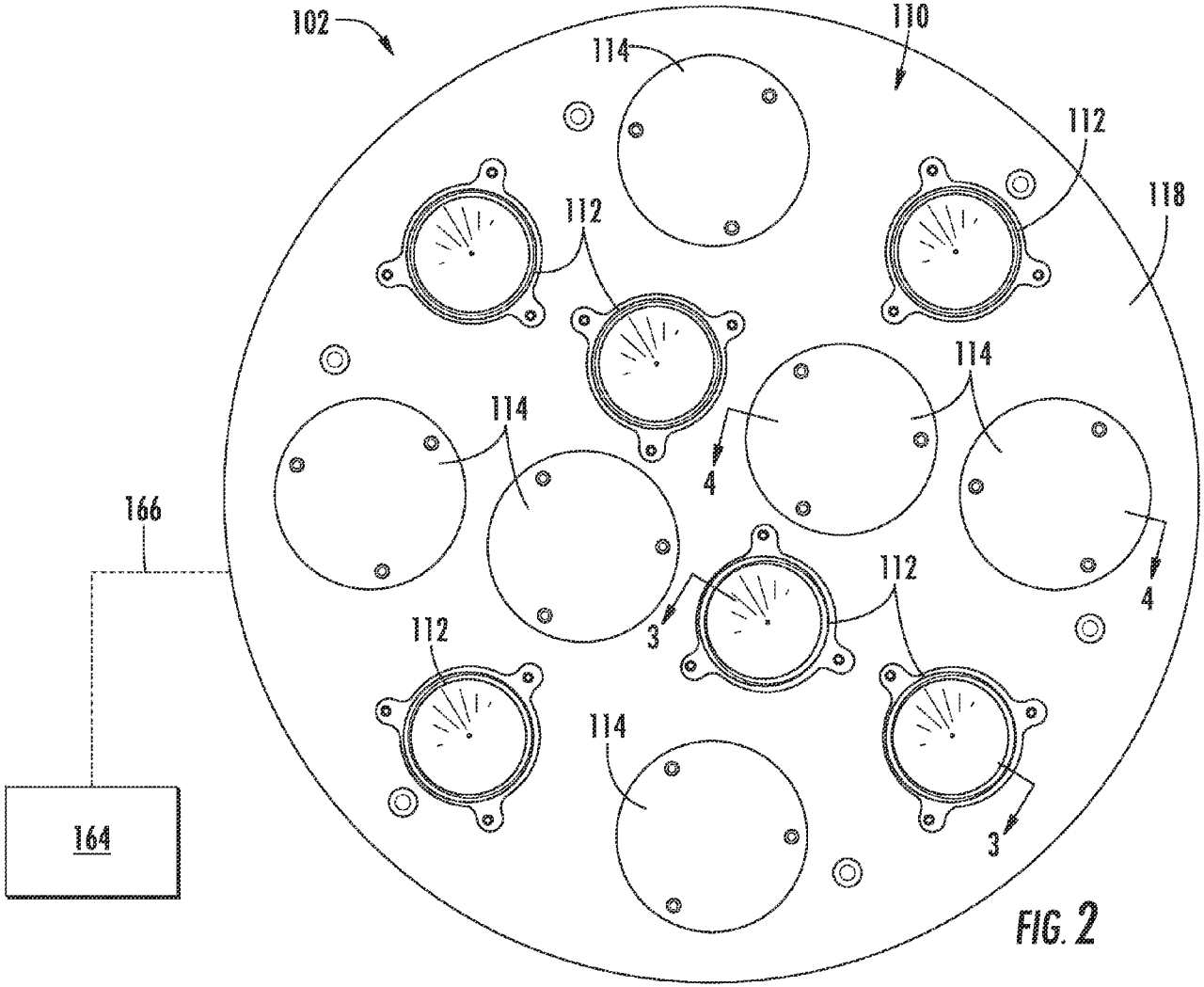
FIG. 2 illustrates a top view of the measurement device shown in FIG. 1.
Figure 3:
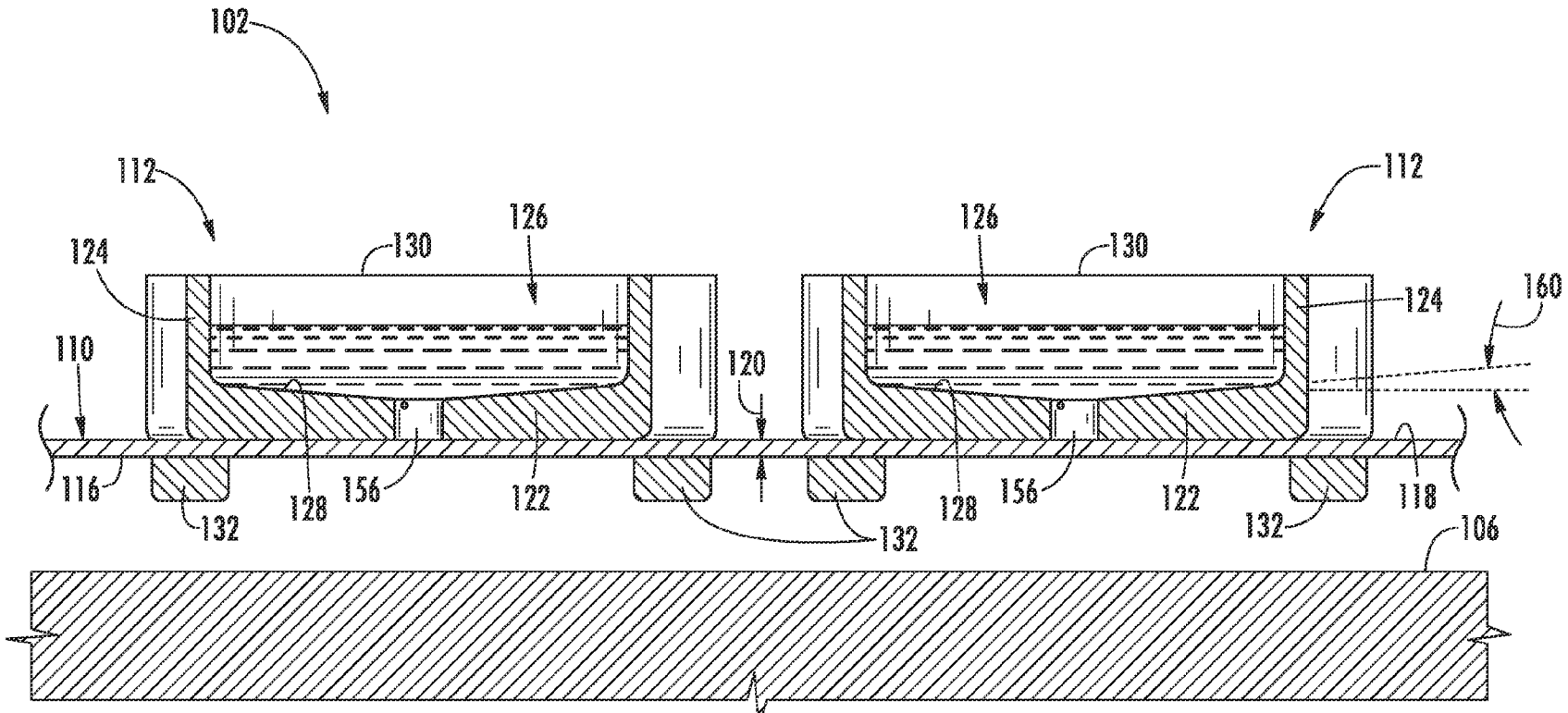
FIG. 3 illustrates a cross-sectional view of the measurement device shown in FIG. 2 taken about line 3-3, particularly illustrating two upper sensor cups of the measurement device.
Figure 4:
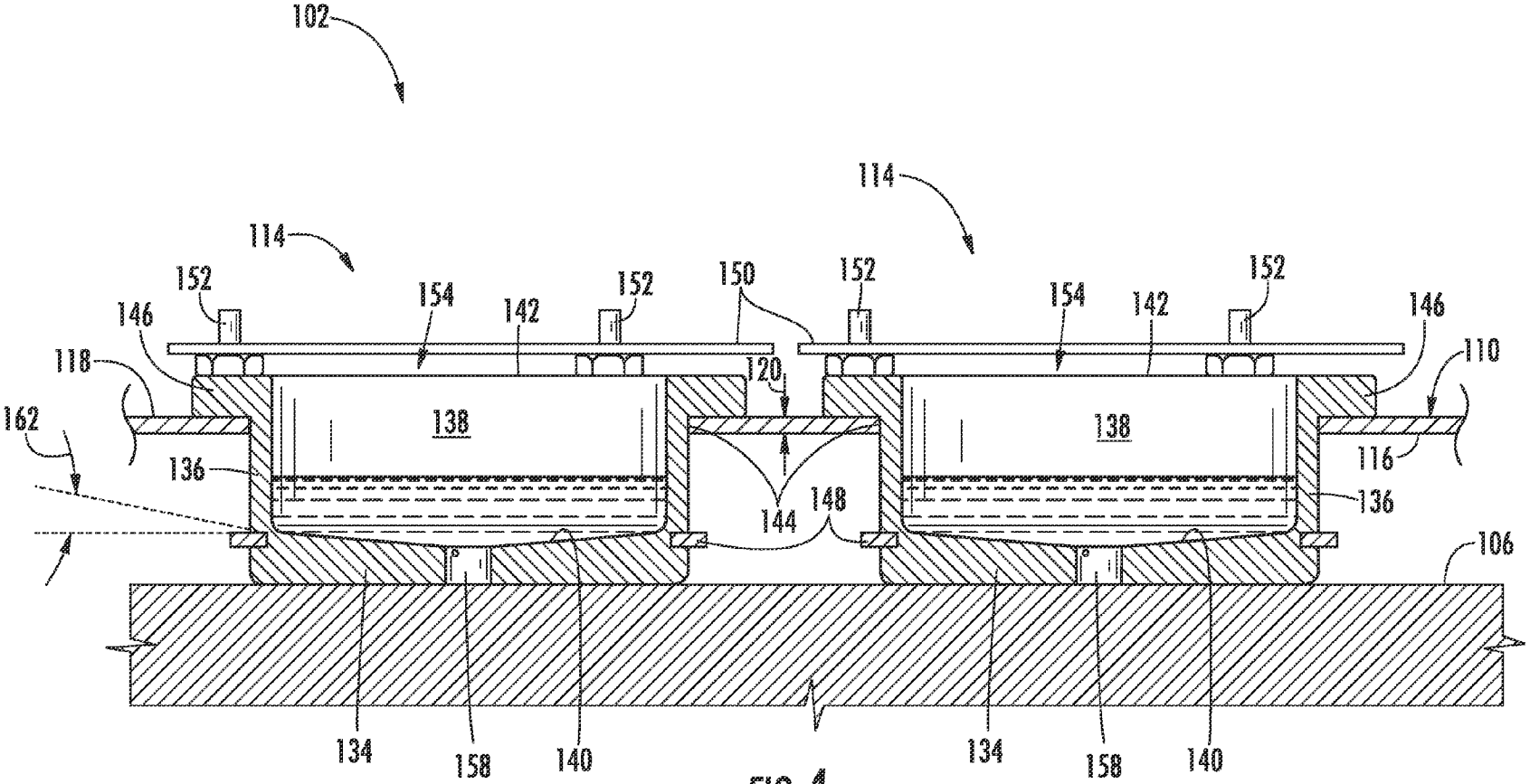
FIG. 4 illustrates another cross-sectional view of the measurement device shown in FIG. 2 taken about line 4-4, particularly illustrating two lower sensor cups of the measurement device.

Referring now to FIGS. 2-4, several views of one embodiment of the measurement device 102 shown in FIG. 1 are illustrated in accordance with aspects of the present subject matter. Specifically, FIG. 2 illustrates a top view of the measurement device 102. FIG. 3 illustrates a cross-sectional view of the measurement device 102 shown in FIG. 2 taken about line 3-3. Additionally, FIG. 4 illustrates another cross-sectional view of the measurement device 102 shown in FIG. 2 taken about line 4-4.

As shown in the illustrated embodiment, the measurement device 102 may include a support plate 110 and a plurality of sensor cups 112, 114 coupled to and/or supported by the support plate 110. In general, the support plate 110 may be configured to provide structural support for the various sensor cups 112, 114 of the measurement device 102. Additionally, as will be described below, the support plate 110 may also serve as an insulating member for one or more of the sensor cups 112, 114. For example, the support plate 110 may be formed from an insulating material (e.g., mica) in order to at least partially shield one or more of the sensor cups 112, 114 from heat transmitted along a given side of the support plate 110.

It should be appreciated that the support plate 110 may generally have any suitable configuration that allows it to function as described herein. For example, as particularly shown in FIGS. 3 and 4, the support plate 110 may define a lower surface 116 configured to face the floor 106 of the oven 100 within which the measurement device 102 is positioned and an upper surface 118 opposite the lower surface 116. Additionally, the support plate may define a thickness 120 between its lower and upper surfaces 116, 118. In general, the thickness 120 of the support plate 110 may be selected based on the desired structural and/or insulating properties for the support plate 110. For example, in one embodiment, the thickness 120 of the support plate 100 may range from about 0.0625 inches to about 0.250 inches, such as from about 0.065 inches to about 0.010 inches and any other subranges therebetween.

It should also be appreciated that the support plate 110 may generally define any suitable shape that allows it to function as described herein. For example, as shown in the illustrated embodiment, the support plate 110 defines a circular shape. However, in other embodiments, the support plate 110 may define any other suitable shape, such as a rectangular shape, a triangular shape or an elliptical shape.

As indicated above, a plurality of sensor cups 112, 114 may be coupled to and/or supported by the support plate 110. Specifically, in several embodiments, the measurement device 102 may include one or more upper sensor cups 112 and one or more lower sensor cups 114. As will be described below, the upper sensor cups 112 may be utilized primarily to monitor the convective and radiative heat transfer occurring along the top side of the measurement device 102 (e.g., along and above the upper surface 118 of the support plate 110). Additionally, the lower sensor cups 114 may be utilized primarily to monitor the conductive heat transfer from the oven floor 106 occurring along the bottom side of the measurement device 102 (e.g., below the lower surface 118 of the support plate 110).

It should be appreciated that the measurement device 102 may generally include any number of upper and lower sensor cups 112, 114. For example, in the illustrated embodiment, the measurement device 102 includes six upper sensor cups 112 and six lower sensor cups 114. However, in other embodiments, the measurement device 102 may include any other number of upper and lower sensor cups 112, 11, including having an unequal number of upper and lower sensor cups 112, 114. Moreover, it should be appreciated that, although the measurement device 102 is generally described herein as including both upper and lower sensor cups 112, 114, the measurement device 102 may, instead, only include upper sensor cups 112 or only include lower sensor cups 114. Such a configuration may be desirable, for example, for use within differing oven configurations.

As particularly shown in FIG. 3, each upper sensor cup 112 may include a bottom wall 122 and a sidewall 124 extending outwardly from the bottom wall 122 so as to define a cavity or liquid well 126. Specifically, as shown in FIG. 3, a top surface 128 of the bottom wall 122 of each upper sensor cup 112 may define the bottom or floor of the liquid well 126, with the well 126 extending upwardly from the bottom wall 122 along the sidewall 124 to an open top end 130 of the sensor cup 112. In several embodiments, the liquid well 126 defined by each upper sensor cup 112 may be configured to receive a volume of liquid, such as water. As will be described below, when the measurement device 102 is positioned within an oven, the liquid contained within each liquid well 126 may be heated via heat transferred from the oven and subsequently evaporate therefrom.

Additionally, as shown in FIG. 2, each upper sensor cup 112 may be configured to be positioned along the top-side of the measurement device 102 such that the bottom wall 122 of the sensor cup 112 is positioned above the upper surface 118 of the support plate 110. As such, each upper sensor cup 112 may be spaced apart vertically from the oven floor 106. Moreover, by positioning each upper sensor cup 112 at least partially above the support plate 110, the upper sensor cups 112 may be shielded by the support plate 110 from the heat transferred from the oven floor 106. For example, as indicated above, the support plate 110 may be formed from an insulating material, such as mica, that minimizes and/or prevents heat from being transferred from the oven floor 106 to the upper sensor cups 112. The insulating properties of the support plate 110 may also serve to minimize and/or prevent heat from being transferred between the various sensor cups 112, 114 of the measurement device 102.

It should be appreciated that the upper sensor cups 112 may be configured to be coupled to the support plate 110 using any suitable attachment means known in the art. For example, as shown in FIG. 3, the upper sensor cups 112 are attached to the support plate 110 using mechanical fasteners 132 (e.g., screws, bolts, pins, etc.) that extend through the support plate 110 and into the sidewall 124 and/or bottom wall 122 of each sensor cup 112. However, in other embodiments, the upper sensor cups 112 may be coupled to the support plate 110 using any other suitable attachment means, such as by welding the components together, using high temperature adhesives or other bonding materials and/or any other means.

Referring particularly to FIG. 4, similar to the upper sensor cups 112, each lower sensor cup 114 may include a bottom wall 134 and a sidewall 136 extending outwardly from the bottom wall 134 so as to define a cavity or liquid well 138. Specifically, as shown in FIG. 4, a top surface 140 of the bottom wall 134 of each lower sensor cup 114 may define the bottom or floor of the liquid well 138, with the well 138 extending upwardly from the bottom wall 134 along the sidewall 136 to a top end 142 of the sensor cup 114. In several embodiments, the liquid well 138 defined by each lower sensor cup 114 may be configured to receive a volume of liquid, such as water, prior to the measurement device 102 being placed within an oven 100.

Additionally, as shown in FIG. 4, at least a portion of each of the lower sensor cups 114 (e.g., the bottom wall 134) may be disposed below the lower surface 116 of the support plate 110. Specifically, the lower sensor cups 114 may be configured to be positioned relative to and/or supported by the support plate 110 such that the bottom wall 134 of each lower sensor cup 114 contacts the oven floor 106 when the measurement device 102 is positioned within an oven 100. For example, in several embodiments, the support plate 110 may define a plurality of cup openings 144, with each lower sensor cup 114 being slidably received within one of the cup openings 114. In such embodiments, as shown in FIG. 4, each lower sensor cup 114 may be vertically retained within its corresponding cup opening 114 between a flange 146 extending outwardly from the sidewall 136 adjacent to the top end 142 of the sensor cup 114 and a removable collar 148 extending outwardly from sensor cup 114 at or adjacent to the bottom wall 134. As will be described below, such retention of the lower sensor cups 114 may allow for each sensor cup 114 to move or slide vertically relative to the support plate 110 between the flange 146 and the collar 148, thereby permitting the sensor cups 114 to be maintained in contact with the oven floor 106 despite any height variations or irregularities defined by the floor 106.

As indicated above, in several embodiments, the lower sensor cups 114 may be configured to primarily monitor the heat transfer occurring via condition from the oven floor 106. As a result, it may be desirable to shield the interior of the liquid well 138 of each lower sensor cup 114 from the convective and radiative heating occurring along the top-side of the measurement device 102. For example, as shown in FIG. 4, a cover plate 150 may be mounted to each lower sensor cup 114 (e.g., via suitable mechanical fasteners 152) such that the top end 142 of each liquid well 138 is at least partially covered by the cover plate 150, thereby at least partially shielding the liquid contained within the liquid wells 138 from the top-side convective and radiative heating. Additionally, when mounting each cover plate 150 to its respective lower sensor cup 114, a small gap 154 may be provided between the top end 142 of the liquid well 138 and the cover plate 150 to allow gases to escape as liquid evaporates from the liquid well 138 due to heat transferred from the oven 100.

It should be appreciated that the sensor cups 112, 114 may generally be formed from any suitable material. However, in several embodiments, the sensor cups 112, 114 may be formed from a relatively lightweight and/or thermally conductive material, such as aluminum and/or other similar metallic materials.

Referring to both FIGS. 3 and 4, the measurement device 102 may also include one or more temperature sensors 156, 158 associated with each sensor cup 112, 114. For example, as shown in FIG. 3, each upper cup sensor 112 may include a first temperature sensor 156 for monitoring the temperature of the liquid contained therein. Similarly, as shown in FIG. 4, each lower cup sensor 114 may include a second temperature sensor 158 for monitoring the temperature of the liquid contained therein. In several embodiments, each temperature sensor 156, 158 may be mounted on or within the bottom wall 122, 134 of its respective sensor cup 112, 114 so as to position the temperature sensor 156, 158 adjacent to the floor of the corresponding liquid well 126, 138. For example, the temperature sensors 156, 158 may be positioned within bottom walls 122, 134 such that each sensor 156, 158 directly contacts the liquid contained within the corresponding liquid well 126, 138. As such, the temperature sensors 156, 158 may provide an accurate measurement of the liquid contained within the sensor cups 112, 114 as the liquid is heated up and evaporates due to heat transferred from the oven 100.

As shown in FIGS. 3 and 4, in several embodiments, the top surfaces 128, 140 of the bottom walls 122, 134 of the sensor cups 112, 114 may be tapered in the direction of the temperature sensor 156, 158 so that the liquid contained within each liquid well 126, 138 flows along the bottom wall 122, 134 in the direction of the temperature sensor 156, 158 as the liquid evaporates, thereby maintaining the liquid in constant fluid contact with the sensor 156, 158. For example, in the illustrated embodiment, each temperature sensor 156, 158 is generally positioned within a central location of the bottom wall 122, 134 of each sensor cup 112, 114. As such, the top surface 128, 140 of the bottom wall 122, 134 may be tapered downwardly from the sidewall 124, 136 towards the center of the bottom wall 122, 134 so that the top surface 128, 140 defines a downward taper angle 160, 162 in the direction of the temperature sensor 156, 158. For instance, in one embodiment, the taper angle 160, 162 defined by each bottom wall 122, 134 may range from about 2.5 degrees to about 15 degrees, such as from about 3 degrees to about 8 degrees and any other subranges therebetween.

It should be appreciated that, in several embodiments, the various temperature sensors 156, 158 of the measurement device 102 may be communicatively coupled to a data storage device 164 for storing the temperature measurements provided by the sensors 156, 158. For example, as shown in FIG. 2, the sensors 156, 158 may be coupled to a separate data storage device 164 via a suitable communicative link 166 (e.g., a wired or wireless connection). By providing the data storage device 164 as a separate device, the device 164 may be configured to be positioned outside of the oven 100 while the measurement device 102 is being used to monitor the temperature of the liquid contained within each sensor cup 112, 114. However, in alternative embodiments, the data storage device 164 may correspond to an on-board storage device positioned on or within the measurement device 102.

Figure 5:
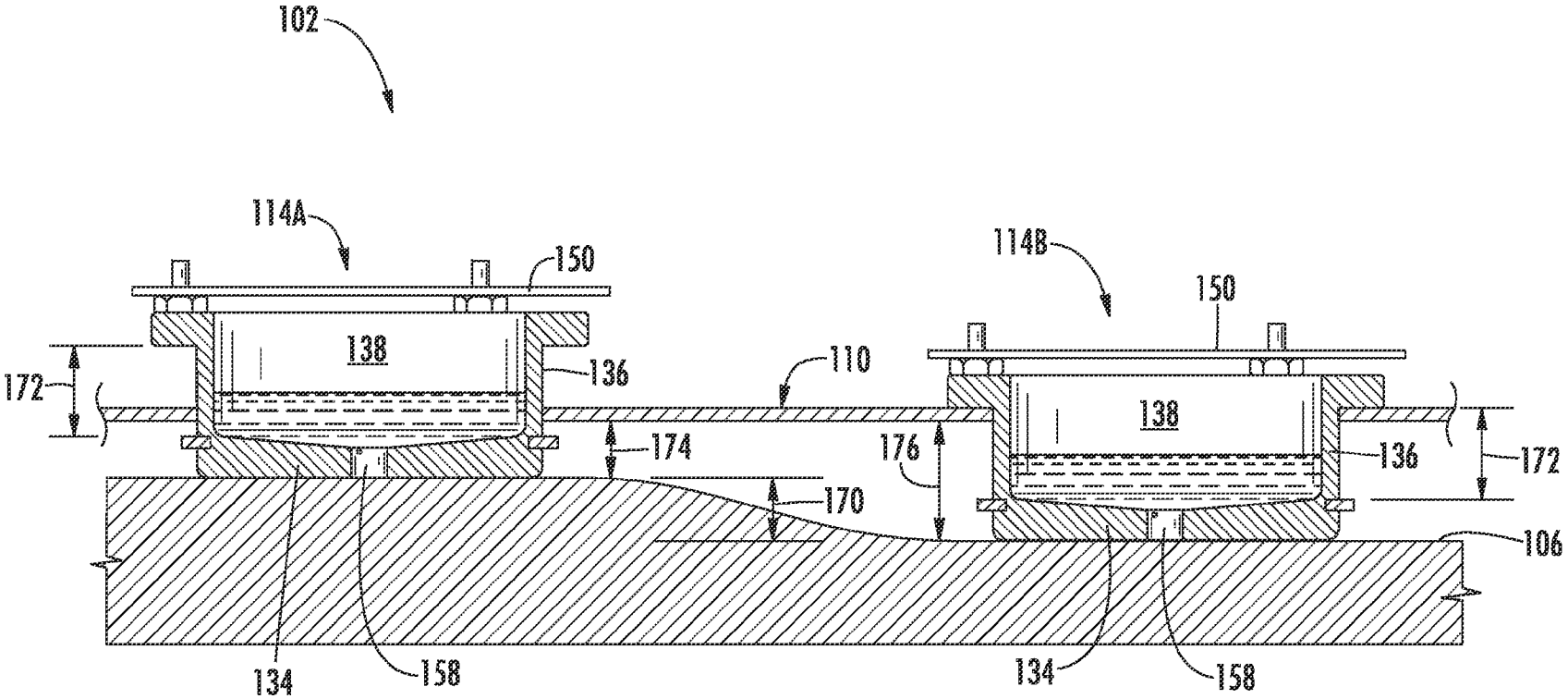
FIG. 5 illustrates a similar cross-sectional view of the measurement device shown in FIG. 4, particularly illustrating the lower sensor cups positioned at differing positions relative to a support plate of the measurement device due to differences in the height of the oven floor.

Referring now to FIG. 5, a similar cross-sectional view to that shown in FIG. 4 is illustrated in accordance with aspects of the present subject matter, particularly illustrating the ability of lower sensor cups 114A, 114B to accommodate variations in the height of the oven floor 106. As shown, a height variation 170 exists along the oven floor 106 between the location of a first lower sensor cup 114A of the measurement device 102 and the location of a second lower sensor cup 114B of the measurement device 102. However, given the mounting configuration of the lower sensor cups 114A, 114B, the vertical position of each lower sensor cup 114 is adjustable relative to the support plate 110 a vertical distance 172 corresponding to the distance defined between the flange 146 and the removable collar 148. Thus, in the illustrated embodiment, when the measurement device 102 is positioned on the oven floor 106, the first sensor cup 114A may slide upwardly relative to the support plate 110 to accommodate the increase in height of the oven floor 106 at the location of the first sensor cup 114A. As such, the support plate 110 may be spaced apart from the oven floor 106 at the location of the first sensor cup 114A by a vertical distance 174 that is less than a vertical distance 176 defined between the support plate 110 and the oven floor 106 at the location of the second sensor cup 114B.

To utilize the disclosed measurement device 102, a known volume of liquid may be initially placed within the liquid well 126, 138 of each sensor cup 112, 114. For example, in one embodiment, a predetermined volume of water may be measured out and poured into each sensor cup 112, 114. Thereafter, the measurement device 102 may be placed within the oven 100 being analyzed. As heat is transferred from the oven 100 to the liquid contained with each sensor cup 112, 114, the temperature sensors 156, 158 may be utilized to monitor the temperature of the liquid over time. The temperature measurements provided by the sensors 156, 158 may then be utilized to determine one or more heating parameters associated with the oven 100.

Figure 6:
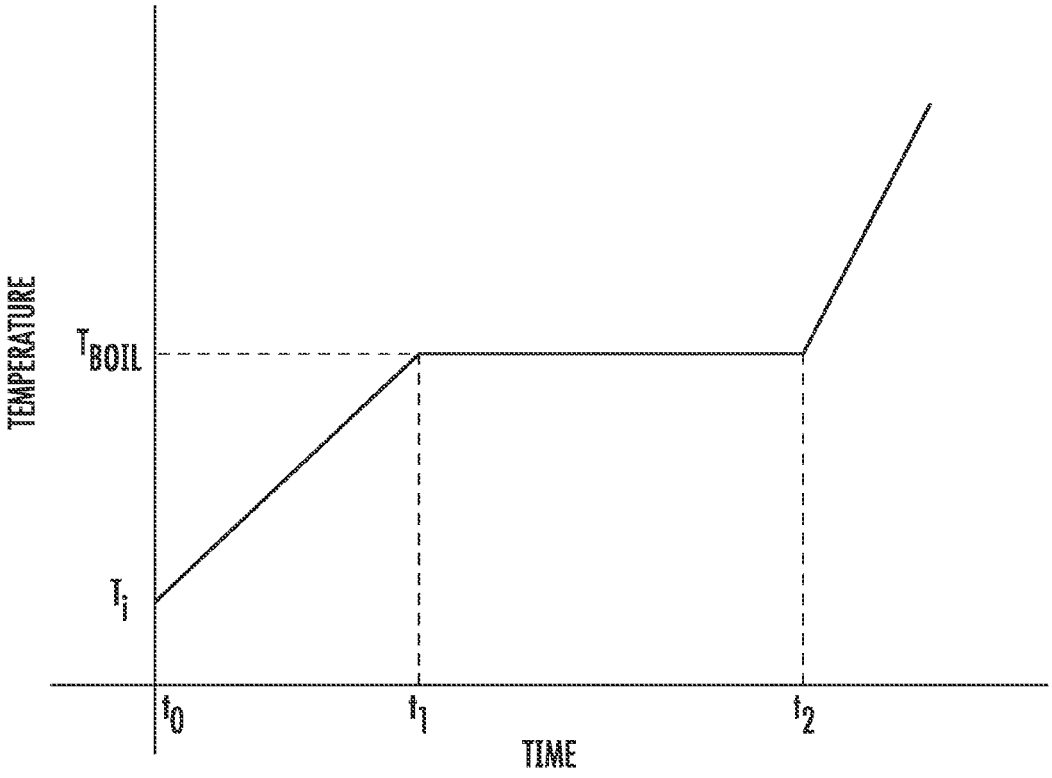
FIG. 6 illustrates example graphical view of temperature measurements taken over time using the disclosed measurement device.

For example, FIG. 6 illustrates a simplified graphical representation of example temperature measurements that may be obtained within a given sensor cup using the disclosed measurement device 102. As shown, the liquid contained within the sensor cup being monitored had an initial temperature ($T_i$) when the measurement device 102 was initially placed within the oven 100 (e.g., at time $t_0$). Thereafter, the temperature of the liquid increased from its initial temperature to its boiling temperature ($T_{boil}$). Upon reaching its boiling temperature (e.g., at time $t_1$), the temperature of the liquid remained generally constant as the liquid within the sensor cup boiled until all of the liquid had evaporated. At such time (e.g., time $t_2$), the temperature measured by the sensor increased rapidly due to the sensor being exposed solely to the significantly hotter air contained within the oven 100.

As indicated above, based on the temperature measurements provided by the temperature sensors 156, 158, one or more heating parameters of an oven may be determined. For example, in one embodiment, the heat energy initially input into the liquid may be calculated based on the temperature measurements, which may then be utilized to determine the power required to increase the temperature of the liquid to its boiling point. Suitable expressions for calculating the heat energy and the corresponding power for increasing the temperature of water contained within one of the sensor cups to its boiling point are provided below as Equations 1 and 2.

$$q_1 = mC\Delta T \tag{1}$$

$$P_1 = \frac{q_1}{t_1} \tag{2}$$

wherein, $q_1$ corresponds to the heat energy input into the water contained within the sensor cup to bring the water to its boiling point, m corresponds to the mass of the volume of water placed into the sensor cup, C corresponds to the specific heat of water, ΔT corresponds to the difference in temperature between the initial temperature of the water (e.g., at time $t_0$ in FIG. 6) and its boiling temperature (e.g., 100° C.), $P_1$ corresponds to the power required to increase the temperature of the water to its boiling temperature and $t_1$ corresponds to the time required increase the temperature of the water from its initial temperature to its boiling temperature (e.g., time $t_1$ in FIG. 6).

Additionally, in one embodiment, the heat energy input into the liquid after the liquid reaches its boiling point may be calculated, which may then be utilized to determine the power required to completely boil away the liquid from the sensor cup. For example, suitable expressions for calculating the heat energy and the corresponding power for completely boiling away water contained within one of the sensor cups are provided below as Equations 3 and 4.

$$q_2 = \Delta H_{vap} m \tag{3}$$

$$P_2 = \frac{q_2}{t_2} \tag{4}$$

wherein, $q_2$ corresponds to the heat energy input into the water to fully boil the water out of the sensor cup, m corresponds to the mass of the volume of water placed into the sensor cup, $\Delta H_{vap}$ corresponds to the heat of vaporization of water, $P_2$ corresponds to the power required to fully boil away the water and $t_2$ corresponds to the time required increase the temperature from its initial temperature to the point at which the water is fully boiled away (e.g., time $t_2$ in FIG. 6).

It should be appreciated that the present subject matter is also directed to a method for determining oven heating parameters. In one embodiment, the method may include positioning the disclosed measurement device within an oven, heating the volume of liquid contained within each liquid well of the measurement device via heat transferred from the oven, monitoring a temperature of the liquid contained within each liquid well over time using the temperature sensors as the liquid is heated and evaporates from each liquid well and determining at least one heating parameter of the oven based on the monitored temperature.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system for determining oven heating parameters, the system comprising:

an oven, the oven defining an oven floor;

a measurement device configured to be positioned within the oven, the measurement device comprising:

a support plate, the support plate defining a lower surface facing the oven floor and an upper surface opposite the lower surface;

an upper sensor cup coupled to the support plate, the upper sensor cup defining an upper liquid well for receiving a first volume of liquid, the upper sensor cup including a bottom wall defining a floor of the upper liquid well, the upper sensor cup being positioned relative to the support plate such that at least a portion of the bottom wall of the upper sensor cup is positioned above the upper surface of the support plate;

a lower sensor cup coupled to the support plate, the lower sensor cup defining a lower liquid well for receiving a second volume of liquid, the lower sensor cup including a bottom wall defining a floor of the lower liquid well, the lower sensor cup being positioned relative to the support plate such that at least a portion of the bottom wall of the lower sensor cup is positioned below the lower surface of the support plate;

a first temperature sensor positioned adjacent to the floor of the upper liquid well such that the first temperature sensor is configured to be in fluid contact with at least a portion of the first volume of liquid received within the upper liquid well, the first temperature sensor being configured to monitor a temperature of the liquid contained within the upper liquid well as the liquid is heated and evaporates from the upper sensor cup due to heat transferred from the oven; and a second temperature sensor positioned adjacent to the floor of the lower liquid well such that the second temperature sensor is configured to be in fluid contact with at least a portion of the second volume of liquid received within the lower liquid well, the second temperature sensor being configured to monitor a temperature of the liquid contained within the lower liquid well as the liquid is heated and evaporates from the lower sensor cup due to heat transferred from the oven.

2. The system of claim 1, wherein the bottom surface of the support plate is configured to be spaced apart from the oven floor.

3. The system of claim 1, wherein the bottom wall of the lower sensor cup is configured to contact the oven floor such that the second volume of liquid is heated at least in part due to conduction from the oven floor.

4. The system of claim 1, wherein the lower sensor cup is configured to be received within a cup opening defined in the support plate.

5. The system of claim 4, wherein the lower sensor cup is slidably received within the cup opening such that a flange of the lower sensor cup is positioned above the upper surface of the support plate and a collar of the lower sensor cup is positioned below the lower surface of the support plate, wherein the lower sensor cup is configured to be moved relative to the support plate along a distance defined between the flange and the collar.

6. The system of claim 1, wherein the lower liquid well is defined by both the bottom wall of the lower sensor cup and a sidewall of the lower sensor cup extending upwardly from the bottom wall to a top end of the lower liquid well, further comprising a cover plate at least partially covering the top end of the lower liquid well.

7. The system of claim 1, wherein the upper liquid well is defined by both the bottom wall of the upper sensor cup and a sidewall of the upper sensor cup extending upwardly from the bottom wall to an top end of the upper liquid well, the top end of the upper liquid well being exposed at least one of radiation or convection from the oven.

8. The system of claim 1, wherein the bottom wall of the upper sensor cup is tapered towards a location of the first temperature sensor such that the first volume of liquid received within the upper liquid well flows along the bottom wall in the direction of the first temperature sensor and wherein the bottom wall of the lower sensor cup is tapered towards a location of the second temperature sensor such that the second volume of liquid received within the lower liquid well flows along the bottom wall in the direction of the second temperature sensor.

9. The system of claim 1, wherein the support plate is formed from an insulating material.

10. The system of claim 1, further comprising a plurality of upper sensor cups and a plurality of lower sensor cups coupled to the support plate.

11. The system of claim 1, wherein the oven comprises a brick oven.

12. A measurement device for determining heating parameters of an oven, the measurement device comprising:

a support plate;

at least one sensor cup coupled to the support plate, the at least one sensor cup defining a liquid well for receiving a volume of liquid, the at least one sensor cup including a bottom wall defining a floor of the liquid well; and a temperature sensor positioned adjacent to the floor of the liquid well such that the temperature sensor is configured to be in fluid contact with at least a portion of the volume of the liquid received within the liquid well, the temperature sensor being configured to monitor a temperature of the liquid as the liquid is heated and evaporates from the at least one sensor cup.

13. The measurement device of claim 12, wherein the support plate defines an upper surface and a lower surface and wherein the at least one sensor cup comprises an upper sensor cup and a lower sensor cup, the upper sensor cup defining an upper liquid well for receiving a first volume of liquid and including a bottom wall defining a floor of the upper liquid well, the upper sensor cup being positioned relative to the support plate such that at least a portion of the bottom wall of the upper sensor cup is positioned above the upper surface of the support plate, the lower sensor cup defining a lower liquid well for receiving a second volume of liquid, the lower sensor cup including a bottom wall defining a floor of the lower liquid well, the lower sensor cup being positioned relative to the support plate such that at least a portion of the bottom wall of the lower sensor cup is positioned below the lower surface of the support plate.

14. The measurement device of claim 13, wherein the lower sensor cup is configured to be received within a cup opening defined in the support plate.

15. The measurement device of claim 14, wherein the lower sensor cup is slidably received within the cup opening such that a flange of the lower sensor cup is positioned above the upper surface of the support plate and a collar of the lower sensor cup is positioned below the lower surface of the support plate, wherein the lower sensor cup is configured to be moved relative to the support plate along a distance defined between the flange and the collar.

16. The measurement device of claim 13, wherein the lower liquid well is defined by both the bottom wall of the lower sensor cup and a sidewall of the lower sensor cup extending upwardly from the bottom wall to a top end of the lower liquid well, further comprising a cover plate at least partially covering the top end of the lower liquid well.

17. The measurement device of claim 13, wherein the upper liquid well is defined by both the bottom wall of the upper sensor cup and a sidewall of the upper sensor cup extending upwardly from the bottom wall to an open top end of the upper liquid well.

18. The measurement device of claim 13, wherein the bottom wall of the upper sensor cup is tapered towards a location of the first temperature sensor such that the first volume of liquid received within the upper liquid well flows along the bottom wall in the direction of the first temperature sensor and wherein the bottom wall of the lower sensor cup is tapered towards a location of the second temperature sensor such that the second volume of liquid received within the lower liquid well flows along the bottom wall in the direction of the second temperature sensor.

19. The measurement device of claim 12, wherein the support plate is formed from an insulating material.

20. A method for determining oven heating parameters, the method comprising:

positioning a measurement device within an oven, the measurement device including a support plate and at least one sensor cup coupled to the support plate, the at least one sensor cup defining a liquid well for receiving a volume of liquid, the at least one sensor cup including a bottom wall defining a floor of the liquid well, the measurement device further including a temperature sensor positioned adjacent to the floor of the liquid well such that the temperature sensor is configured to be in fluid contact with at least a portion of the volume of the liquid contained within the liquid well;

heating the volume of liquid contained within the liquid well via heat transferred from the oven;

monitoring a temperature of the liquid contained within the liquid well over time using the temperature sensor as the liquid is heated and evaporates from the liquid well; and determining at least one heating parameter of the oven based on the monitored temperatures.

* * * * *